US005106294A

United States Patent [19]

Profos

[11] Patent Number: 5,106,294

[45] Date of Patent: Apr. 21, 1992

[54] METHOD AND ARRANGEMENT FOR REDUCING THE EFFECT OF DISTURBANCES ON THE COMBUSTION OF A FAN BURNER SYSTEM

[75] Inventor: Paul Profos, Winterthur, Switzerland

[73] Assignee: Conel AG, Switzerland

[21] Appl. No.: 670,367

[22] Filed: Mar. 14, 1991

Related U.S. Application Data

[63] Continuation of Ser. No. 338,993, Apr. 14, 1989, abandoned.

[30] Foreign Application Priority Data

Apr. 16, 1988 [DE] Fed. Rep. of Germany ..... 3812697

[51] Int. Cl.[5] ..... F23N 1/02; F23N 3/00; G01N 9/32

[52] U.S. Cl. ..... 431/12; 431/90; 73/30.02

[58] Field of Search ..... 431/12, 22, 62, 89, 431/90; 73/30.01, 30.02, 32 R; 137/114; 123/494; 236/86, 92 D

[56] References Cited

U.S. PATENT DOCUMENTS

| | | | |
|---|---|---|---|
| 424,617 | 4/1890 | Powers | 236/86 X |
| 2,371,428 | 3/1945 | De Giers et al. | 236/86 X |
| 2,470,742 | 5/1949 | Haase et al. | 236/92 D |
| 2,601,777 | 7/1952 | Woodward | 73/30 |
| 2,638,784 | 5/1953 | Cesaro et al. | 73/30 X |
| 3,365,932 | 1/1968 | Greene, Jr. | 73/30 |
| 3,701,280 | 10/1972 | Stroman | 73/30 X |
| 3,818,877 | 6/1974 | Barrera et al. | 123/494 |
| 4,050,878 | 9/1977 | Priegel | 123/488 |
| 4,320,652 | 3/1982 | Nakamura | 73/30 |
| 4,457,694 | 7/1984 | Maeda et al. | 431/90 |

FOREIGN PATENT DOCUMENTS

| | | |
|---|---|---|
| 0086337-B1 | 3/1987 | European Pat. Off. . |
| 2190515 | 4/1986 | United Kingdom . |
| 2185810 | 1/1987 | United Kingdom . |

OTHER PUBLICATIONS

Japanese Patent Abstract JP-A-60105822 Nov. 6, 1985.

*Primary Examiner*—Carl D. Price

*Attorney, Agent, or Firm*—Ostrolenk, Faber, Gerb & Soffen

[57] ABSTRACT

A method for reducing the effect of disturbances, affecting the combustion of a fan burner system, including an arrangement for measuring the relative change of density of a gas as a function of its pressure and of its temperature and/or measuring a relative mass flow change of the gas as the function, at an at least nearly constant volume flow of the gas.

10 Claims, 3 Drawing Sheets

$$\frac{P_a - P_v}{P_{ao}} = \frac{\Delta \varrho_a}{\varrho_{ao}} \Bigg|_{v^* \approx const.} \approx \frac{\Delta L^*}{L_o^*}$$

METHOD AND ARRANGEMENT FOR REDUCING THE EFFECT OF DISTURBANCES ON THE COMBUSTION OF A FAN BURNER SYSTEM

This is a continuation of application Ser. No. 07/338,993 filed on Apr. 14, 1989.

BACKGROUND OF THE INVENTION

The present invention is related to a method for reducing the effect of disturbances, affecting the combustion of a fan burner system, and to a fan burner arrangement with a fan burner. It relates more particularly to a method and an arrangement for measuring the relative change of density of a gas as a function of its pressure and of its temperature, and/or measuring a relative mass flow change of said gas as said function, at an at least nearly constant volume flow of said gas.

In fan burners it is known to act on the mass flow of combustion air and on the mass flow of fuel, e.g. with the aid of a compound open loop feed forward control or with the aid of a compound negative feedback closed loop control according to a desired loading. To ensure an at least nearly optimal combustion at all loading levels, and especially combustion that is substantially independent from influences caused by disturbances, it is known to measure the oxygen content of the flue-gas as a controlled variable and to provide a negative feedback loop control circuit which regulates said oxygen content within the flue-gas to follow or to be kept at a control value, by adjusting the combustion air and/or the fuel fed to the burner. Thereby said oxygen content is clearly not a disturbing variable, as a disturbing variable may, per definitionem, not be changed by the process disturbed thereby. The expenditures for such negative feedback control techniques are relatively high, especially because of the oxygen, sensor to be provided and because of the negative feedback controllers.

Further, problems of stability may here occur and must be resolved which is not always easily done, especially due to the controlled system formed by the combustion chamber and the flue-gas pipes up to the area where the oxygen content measurement is performed which controlled system is a difficult system from the point of view of negative feedback control.

Such problems of stability may in fact be resolved, but with great technical efforts. Such measures to optimize combustion by negative feedback control techniques are disclosed in the EP-A-0 086 337.

For smaller burner arrangements, as for household burner arrangements, the effort required for installing and operating such negative feedback controls is often much too high. On the other hand, the totality of such smaller burner arrangements does significantly contribute to pollution of the air.

SUMMARY OF THE INVENTION

It is thus a first object of the present invention to provide a method for reducing the effect of disturbances affecting the combustion and especially the fuel to combustion air ratio of a fan burner system, in which the above mentioned drawbacks of negative feedback control arrangements do not occur and nevertheless a good combustion is ensured.

This object is achieved by providing said method, comprising the steps of measuring at least a part of the disturbances which affect the combustion and especially the fuel/combustion air ratio of the fan burner system and acting with at least one signal according to said disturbances measured in an open loop feed-forward-connection on control means, for at least one of fuel flow and of combustion airflow for said burner system to compensate for said effect caused by at least said part of said disturbances.

By the fact that no negative feedback, but only an open loop feed-forward-control is provided, realization of such improved method becomes relatively inexpensive and technically most transparent, so that the possibility is given to considerably improve combustion of fan burner arrangements with relatively small efforts which may be invested in small burner arrangements too.

Thereby, the effects caused by disturbances are significantly reduced and the problems of stability will not occur because these problems only occur in negative feedback control systems and not in open loop feed-forward-controlled systems. The technical efforts are reduced to such an amount that significant improvements of combustion in small burner arrangements become economically reasonable.

In a preferred embodiment of the inventive method, the step of measuring at least a part of the disturbances comprises measuring pressure and temperature of the combustion air.

Thereby it is recognized that by considering pressure and temperature of the combustion air, i.e. the air led to the burner, the predominant part of the effect of disturbances is counteracted in such burner arrangements. Therefore, it is preferred to exclusively measure said pressure and said temperature. By such a selective measurement of the main disturbances, namely of pressure of the combustion air and of the temperature of said air, which both may be performed in the area surrounding the burner, but which both are preferably performed at or adjacent the intake of a fan for the burner, on the one hand the efforts required for the measurements are minimal, and on the other hand the result is a most simple compensating adjustment of the mass flow of combustion air and/or of the mass flow of fuel.

Such a simple compensation is preferably done as follows:

The relative change of m ass flow of the combustion airstream to the burner is determined from the result of a measurement process which measures an occurring change of combustion air pressure relative to a reference combustion air pressure, and of subtracting from said relative pressure change measured, a measured change of combustion air temperature relative to a reference temperature value of the combustion air. The result of such a subtraction is a change of combustion air density relative to a reference value of density and is at least in a first approximation equal to a change of mass flow of combustion air relative to mass flow of combustion air under said reference conditions. Thereby an at least nearly constant volume flow of the combustion airflow to the burner should be maintained. Reference values are all taken under the same reference condition of the combustion air.

By such simple measurements and subtraction, the relative change of combustion air mass flow caused by the disturbances, namely pressure and temperature, is obtained and compensation is performed by adjusting the mass flow of the combustion air to the burner according to the inverse result of the above mentioned subtraction.

If additionally or instead of acting on the mass flow of combustion air, one may act on the mass flow of fuel. This is easily performed by adjusting said mass flow of fuel according to the result of the above mentioned subtraction, i.e. according to a relative change of the mass flow of combustion air which results from the relative change of pressure and the relative change of temperature as measured in the combustion air.

Therefore, it becomes evident that for the most simple and preferred kind of realization of the inventive method, there suffices an air pressure and an air temperature measurement within the combustion air, i.e. within the air surrounding the burner. It is clear that these two measurements may be performed by any kind of known sensors, a temperature sensor and a pressure sensor arranged in the surrounding air of the burner. Nevertheless it is preferred to take the said measurement at or adjacent the intake of the fan of the burner.

It is a second object of the present invention to provide for a simple method for measuring either of a relative change of density of a gas as a function of its pressure and of its temperature; and/or of a relative change of mass flow of said gas as said function at an at least nearly constant volume flow of said gas.

As may be noted, it is just the problem of measuring the relative mass flow change of a gas, namely the combustion air, as a function of its pressure and of its temperature and at an at least nearly constant volume flow of combustion air, which in fact must be resolved to realize in one preferred way the above mentioned method for reducing the effect of disturbances on a fan burner system, so that solution of the second object of the present invention will well apply to the inventive method for reducing the effect of disturbances and will considerably reduce the efforts required for realizing the latter method too.

Application of the technique according to the second object to that according to the first object is performed by considering the combustion air to be the gas to be measured.

According to the second object, proposed is a method wherein the relative mass flow change of a gas as a function of its pressure and temperature is determined by providing a closed and constant volume of a measuring gas, coupling said volume isothermically to the gas to be measured, and measuring a pressure difference change between the pressure of the gas to be measured and the pressure of the measuring gas, as said relative change of mass flow of the gas to be measured.

Thus, by applying this latter method, inventive per se, to the above mentioned method of reducing the effect of disturbances in a fan burner system, it is proposed to measure the relative change of combustion air mass flow caused by the disturbances, by providing a volume flow of combustion air which is at least nearly constant, further by providing a closed and constant volume of a measuring gas, coupling said volume of measuring gas isothermically to the combustion air and measuring a change of a pressure difference between a pressure of said measuring gas of said volume and a pressure of said combustion air, and applying said change of mass flow of the combustion air thus measured for carrying out a compensating adjustment of at least one of the mass flow of combustion air led to the burner and of the mass flow of fuel led to said burner, as was described above.

Thus, the method of measuring according to the second object of the present invention results in the possibility to measure with a single measurement a relative change of mass flow of a gas and thus of combustion air in the technique according to the first object as a function of its temperature change and of its pressure change.

With respect to said inventive measuring method, the following may be considered:

The following simple relation is valid between a relative pressure difference of pressure in a gas and pressure in a measuring gas which both are isothermically coupled:

$$\frac{p_L - p_v}{p_{Lo}} \approx \frac{\Delta p_L}{p_{Lo}} - \frac{\Delta \theta_L}{T_{Lo}} = \frac{\Delta \rho_L}{\rho_{Lo}}$$

wherein:

$$\frac{p_L - p_v}{p_{Lo}}:$$

measured difference between the pressure of gas to be measured ($p_L$) and pressure of the measuring gas ($p_v$) with respect to a pressure of the gas to be measured at reference conditions ($p_{Lo}$), $$\frac{\Delta p_L}{p_{Lo}}:$$

a change of the pressure in the measuring gas relative to said pressure at said reference conditions, $$\frac{\Delta \theta_L}{T_{Lo}}:$$

a change of the temperature of said measuring gas with respect to its temperature at said reference conditions.

At the beginning of such a direct measurement of a change of mass flow of the gas to be measured, equilibrium there is established between the measuring gas and the gas to be measured with respect to pressure, and thereby the said pressure reference value $p_{Lo}$ is fixed as well as $T_{Lo}$. The measured relative pressure difference is then equal to the relative change of density within the gas to be measured and is at least nearly equal to the relative change of mass flow of said gas, when the volume flow of the gas to be measured is kept at least nearly constant.

An inventive fan burner arrangement which is controlled according to the inventive method, for reducing the effects of disturbances, which was discussed above, comprises a combustion air feed and a fuel feed, a measuring arrangement for measuring at least one disturbing variable, disturbing the combustion of the burner, whereby an output of the measuring arrangement is open loop forward coupled to a combustion airflow adjusting means and/or a fuel flow adjusting means of the combustion air feed and of the fuel feed respectively.

In view of the predominant effect of combustion air pressure and combustion air temperature on the combustion of the fan burner and especially on the fuel to air ratio of the burner, a preferred embodiment of that arrangement comprises a sensor arrangement for measuring a relative change of pressure and a relative change of temperature of the combustion air with respect to a reference pressure and a reference temperature of the combustion air.

In order to resolve in a very simple manner the above mentioned second object of the present invention, namely of measuring one of a relative change of density of a gas (as a function of its pressure and of its temperature) and of a relative change of mass flow of the gas (as a function of its pressure and of its temperature) and at an at least constant volume flow of the gas, an arrangement for such a measurement is inventively provided, which comprises a closed rigid receptacle for a measuring gas, said receptacle for said measuring gas is isothermically coupled to the gas to be measured. This arrangement further comprises a pressure measuring arrangement which measures a pressure difference between a pressure within the receptacle for the measuring gas and a pressure of the gas to be measured. The receptacle is preferably arranged at the intake of the fan of the burner.

This measuring arrangement, inventive per se, is preferably also applied in the above mentioned inventive fan burner arrangement. In that case the measuring arrangement for measuring at least one disturbing variable comprises the closed rigid receptacle, filled with a measuring gas. The receptacle is isothermically coupled to the combustion air for the burner. The arrangement further comprises a pressure measuring arrangement which measures a pressure difference between the pressure of the measuring gas within the receptacle and the pressure of the combustion air for the burner. The output of the pressure measuring arrangement is open loop forward coupled to at least one of the fuel flow adjusting means and of the airflow adjusting means.

Preferably the receptacle with the measuring gas comprises a vent to establish an initial pressure equilibrium between the measuring gas within said receptacle and the combustion air, as said reference condition for pressure and temperature.

The inventive fan burner arrangement preferably comprises a fan burner which is to be operated at distinct values of loading, which is operated e.g. at one or two distinct loading levels.

Summarizing, the present invention is thus directed to a method and an arrangement for reducing the effects of disturbances on fan burner systems. It is further directed to a method and arrangement for easily measuring a relative change of density of a gas as a function of its pressure and of its temperature, or measuring a relative mass flow change of a gas as such a function. An at least nearly constant volume flow of the gas should be maintained. The method and arrangement for measuring either the change of density or the relative mass flow change, are preferably used to perform such measurements in the above mentioned context of reducing the effect of disturbances affecting the combustion of the fan burner systems.

Further advantages and preferred embodiments of the invention will become evident when reading the following detailed description of the figures which disclose by way of example the present invention.

DETAILED DESCRIPTION OF PREFERRED EMBODIMENTS

Figure 1:
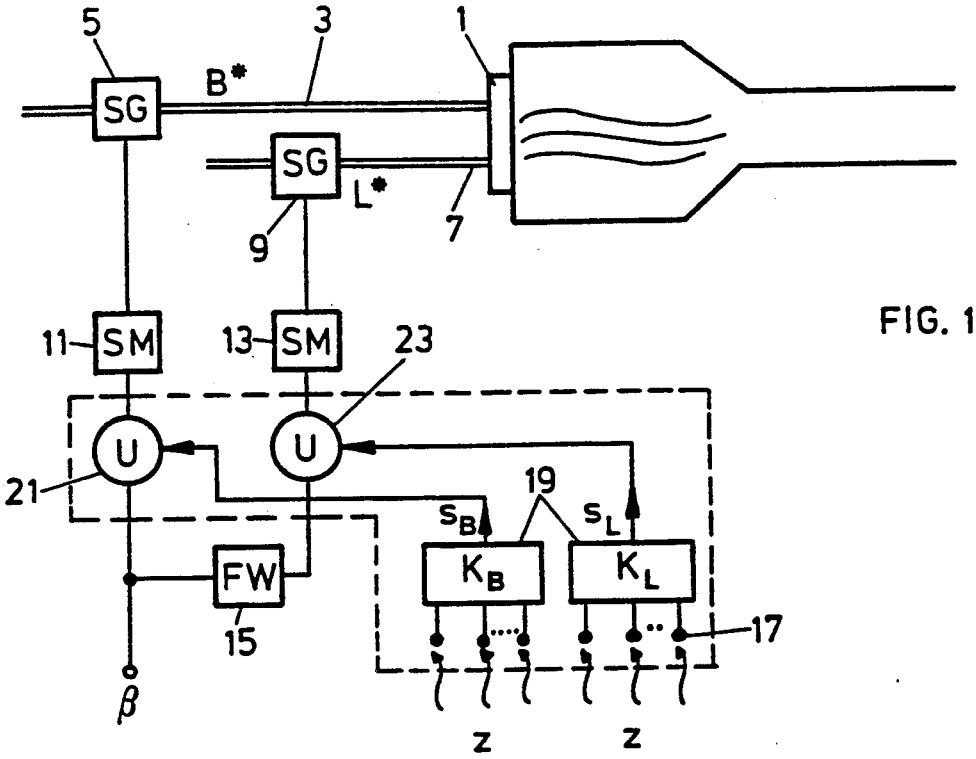
FIG. 1 shows an arrangement in a fan burner system for providing with disturbing variable compensation according to the present invention.

In FIG. 1 there is schematically shown a burner 1 for burning fuel material with practically constant heating value for example oil EL, natural gas etc. A fuel stream B* is led to the burner 1 by means of a conduit 3 with an adjusting member 5 and analogically a combustion air stream L* is led to the burner 1 via a conduit 7 and is adjusted by an adjusting member 9. Both adjusting members 5 and 9 are driven by controlling motors 11 and 13. A function converter 15, as e.g. realized by a cam plate or an electronic function generator, controls the ratio of fuel and air according to a loading factor $\beta$ required and in dependency upon a control signal which represents the loading factor $\beta$.

Such a compound feed forward control at which additionally the pressure of the fuel B* may be adjusted, is known in different forms of realization.

According to the dashed block of FIG. 1, disturbing values d, as e.g. fuel pressure, specific air requirement, air temperature, air pressure, humidity of air, conditions within the flue pipes which are not affected directly by the combustion setting, are inventively measured with a sensor arrangement 17 and are led to a compensator arrangement 19 after having been converted to electrical signals. There these signals are combined by calculation. At the output side of the compensator arrangement 19, schematically shown in FIG. 1, compensation signal $s_B$ and $s_L$ are generated. They are each led to heterodyne units 21, 23 respectively, within fuel flow and/or combustion airflow pipes 3, 7. Thereby the influence of the disturbing values d, which are measured, is compensated by adjusting fuel flow and/or combustion airflow by means of the adjusting members 5 and 9 respectively.

If one considers the influence of the different disturbing values d, which were mentioned above, on the combustion of a burner, i.e. on the air factor $\lambda$ within the flue-gas, it will become evident that the predominant part of the total influence is due to changes of pressure and of temperature of the combustion air, especially for burners which are operated at distinct loading levels:

For one level burners, over 90% of all effects caused by disturbances are due to air pressure and air temperature changes. This is true because the effects of the other disturbance values on the combustion and especially on the combustion-air-to-fuel-ratio may be neglected or because they are correlated with air pressure and/or air temperature.

It results that at least in a first approximation and under consideration of the gas equation, further for an at least constant volume flow of combustion air, which latter condition is fulfilled during operation of a burner at constant loading $\beta$, the following relation is valid between a relative change of combustion air mass flow and relative changes of air pressure and air temperature:

$$\frac{\Delta L^*}{L_o^*}/_d \approx \frac{\Delta p_L}{p_{Lo}} - \frac{\Delta \theta_L}{T_{Lo}} \quad (1)$$

In this expression:

$$\frac{\Delta L^*}{L_o^*}:$$

a relative change of mass flow combustion air; $L_o^*$ being the mass flow of combustion air at reference conditions; an at least nearly constant combustion air volume flow being maintained, d : indication for "caused by disturbances", $$\frac{\Delta p_L}{p_{Lo}}:$$

a pressure change of combustion air led to the burner related to a pressure of said combustion air, $p_{Lo}$, at the reference conditions, this change being measured preferably at the intake region of the fan of the burner, $$\frac{\Delta \theta_L}{T_{Lo}}:$$

a change of temperature of the combustion air led to the burner related to a value ($T_{Lo}$) of absolute temperature (K) according to the combustion air temperature at said reference conditions, this change too being measured preferably at the intake region of the fan of the burner.

It becomes evident that the relative change of the mass flow of combustion air at an at least nearly constant volume stream of this air is at least nearly equal to the difference of the relative change of its pressure and the relative change of its temperature.

The influence of these predominant or main disturbance values, i.e. of air pressure and of air temperature, is now inventively compensated by a feed-forward open loop compensation control, by which an adjustment of the mass flow of combustion air is performed at least in a first approximation according to $$\frac{\Delta L^*}{L_o^*}/_{comp} \approx -\frac{\Delta L^*}{L_o^*}/_d \quad (2)$$

In this expression:

comp: indication for "caused by compensating adjustment".

Additionally or instead of acting on the mass flow of the combustion air, compensation may be performed by adjustment of the mass flow of fuel, again at least in a first approximation according to:

$$\frac{\Delta B^*}{B_o^*}/_{comp} \approx \frac{\Delta L^*}{L_o^*}/_d \quad (3)$$

In this expression:

$$\frac{\Delta B^*}{B_o^*}:$$

change of mass flow of the fuel led to the burner relative to its mass flow at the reference conditions.

Figure 2:
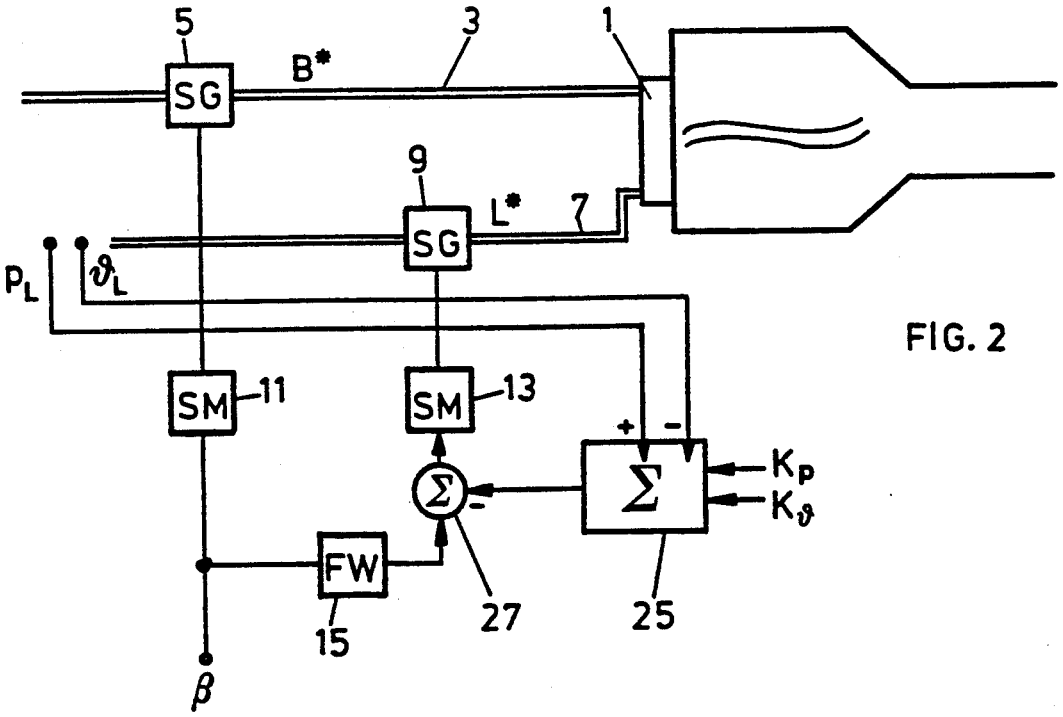
FIG. 2 shows a preferred embodiment of the inventive burner system arrangement and illustrates a preferred form of execution of the inventive method of reducing the effects of disturbances.

In FIG. 2 there is shown an inventive fan burner arrangement which takes the above mentioned considerations into account and which is provided with a compensating arrangement for compensating the influence of the predominant disturbance values. To do this, the air temperature $\theta_L$ and the static air pressure $p_L$ are measured in the combustion air as in the air stream L* to the burner at the intake of the fan, which burner is constructed as was principally shown in FIG. 1.

After a respective conversion of the values $\theta_L$ and $p_L$ measured into electrical signals, these electrical signals are led to a compensator unit 25. At the compensator 25 which acts according to formula (1) as a heterodyne unit, coefficients $K_p$ and $K_\theta$ are adjusted according to scaling factors $1/\rho p_{Lo}$ and $1/T_{Lo}$ of (1). The pressure measuring signal is first weighted at the compensator unit 25 with the scaling factor $K_p$ and, analogically, the temperature measuring signal by the factor $K\theta$. By forming the difference according to (1), the compensator 25 forms, in an electrical analogous manner, the expression which stands at the right hand side in formula (1).

According to the embodiment of FIG. 2, the output signal of the compensator unit 25 which represents, in form of an electrical signal, the result of (1) is inverted according to (2) and is led to a heterodyne unit 27 within the command signal path for the air stream L* where it is heterodyned or superposed with the adjusting signal which is dependent upon the loading factor $\beta$ which is required.

If it is preferred to act on the command signal for the fuel flow B* this is done in analogy and according to formula (3) at a heterodyning unit within the command signal path for the fuel led to the burner.

To adjust the weighting factors or coefficients $K_p$ and $K\theta$ of FIG. 2, electric reference signals are adjusted, e.g. at an optimum adjustment of the combustion, for example during the first operation of a burner system, according to the pressure and temperature values which are then valid according to $p_{Lo}$ and $T_{Lo}$.

Figure 3:
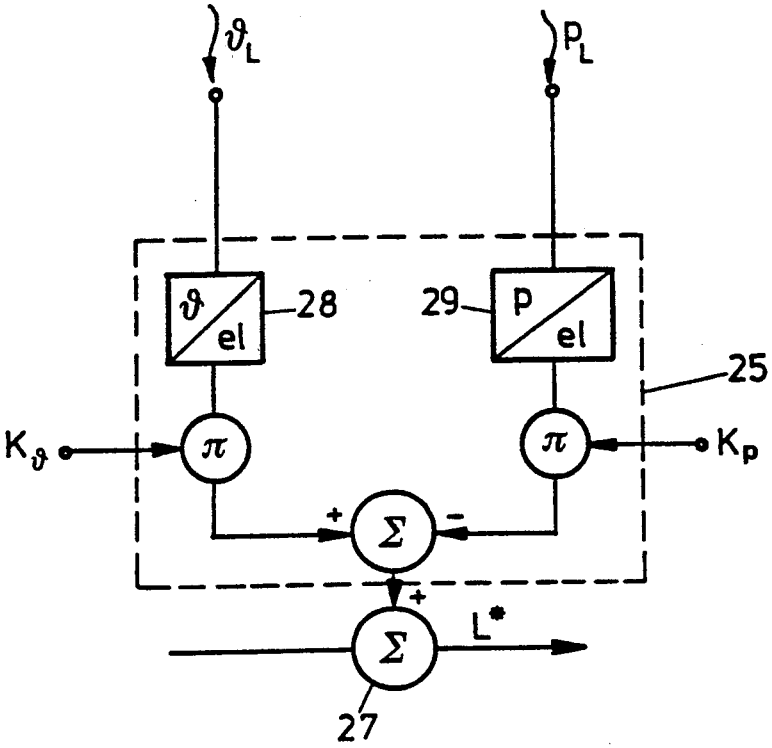
FIG. 3 is a schematic block diagram of the disturbance value compensation circuit in the arrangement according to FIG. 2, FIG. 4 schematically illustrates an inventive measuring arrangement for measuring a relative change of density of a gas as a function of its pressure and of its temperature or for measuring a relative change of a gas mass flow at a constant gas volume flow, and FIG. 5 schematically illustrates a part of a further preferred realization form of a fan burner arrangement according to the present invention and operating according to the method of the present invention.

In FIG. 3 a detailed construction of the compensator 25 for adjusting the air mass flow L* is shown. As converters 28 and 29 for the values $\theta_L$ and $p_L$ well-known sensors may be used with electrical output signals as e.g. thermo elements, resistance thermometers and pressure sensors.

A further object which is now to be resolved is to measure in a simplest possible manner a relative change of the mass flow of combustion air as a function of relative changes of combustion air pressure and combustion air temperature.

According to FIG. 2, this may be realized by separately measuring air pressure and air temperature and by appropriately weighting the measuring results, then by realizing a calculation according to formula (1).

In the following there will be described a most simple combined measuring method and a respective arrangement, the result of which or the output signal of which, respectively, directly indicating the relative change of mass flow of a gas, i.e. of the combustion air. This under the presumption of at least nearly constant volume flow of the gas.

The desired result, namely the relative change of gas mass flow, results from the one value which is in fact measured, namely from the relative change of gas density. Thereby one starts with the fact that in a rigid, closed receptacle which is filled with a gas, which filling gas is in thermal equilibrium with the surrounding gas atmosphere, the relative difference pressure between surrounding and filling gas is equal to the relative change of the density of the surrounding gas and is, at a constant gas volume stream, equal to the relative change of the air mass stream of the surrounding gas. Thus, following the formula is valid at least in a first approximation:

$$\frac{p_L - p_v}{p_{Lo}} = \frac{\Delta p_L}{p_{Lo}} - \frac{\Delta\theta_L}{T_{Lo}} = \frac{\Delta\rho_L}{\rho_{Lo}} \overset{V^* \simeq \text{const.}}{\approx} \frac{\Delta L^*}{L_o^*} /_d \quad (5)$$

wherein:

$$\frac{p_L - p_v}{p_{Lo}}:$$

pressure difference between the surrounding gas ($p_L$) and the filling gas ($p_v$) of the receptacle with respect to a pressure ($p_{Lo}$) at reference conditions, $$\frac{\Delta p_L}{p_{Lo}}:$$

change of the pressure ($p_L$) of the surrounding gas relative to the pressure ($p_{Lo}$) of said surrounding gas at said reference conditions, $$\frac{\Delta\theta_L}{T_{Lo}}:$$

change of the temperature ($\theta_L$) of the surrounding gas relative to a temperature ($T_{Lo}$) of said surrounding gas at said reference conditions, $$\frac{\Delta\rho_L}{\rho_{Lo}}:$$

change of density ($\rho_L$) of said surrounding gas with respect to its density ($\rho_{Lo}$) at said reference conditions, $v^*$: the gas volume flow of said surrounding gas.

It becomes evident that if for establishing the pressure reference value $P_{Lo}$, the pressure within the receptacle, $p_v$, is made equal to the pressure surrounding the receptacle, $p_L$, as may be done by simple pressure equalization, the relative density or gas mass flow change as a function of surrounding pressure ($p_v$) and temperature ($\theta_L$) directly results from a difference pressure measurement between pressure of the filling gas within the receptacle and its surrounding gas.

This most simple method is preferably also used for monitoring the change of mass stream of the combustion air due to the predominant disturbances (air temperature and air pressure) in the inventive fan burner arrangement in which inventively the effects of disturbances are compensated. Nevertheless, it must be pointed out that principle such a simple approach may be used everywhere a gas density change or a gas mass flow change shall be monitored as a function of gas pressure and gas temperature.

Figure 4:
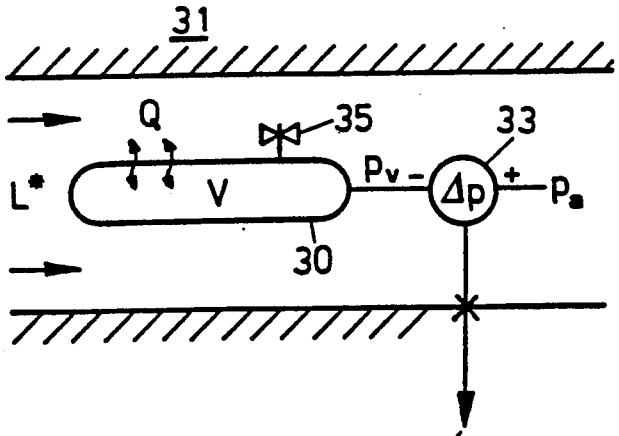

According to FIG. 4 the inventive measuring method is realized by encapsulating a gas volume V into a closed, rigid receptacle 30. The receptacle 30 is disposed into a gas stream L*. Between the gas stream L* and the gas volume V there is installed a good thermal conductance as is shown by Q so that there results $T_L = T_V$: the temperature inside the receptacle is equal to the temperature outside the receptacle.

With the help of a difference pressure sensor 33, the difference between the static pressure $p_L$ within the gas stream L* and the pressure $p_v$ within the receptacle 30 is measured. To establish reference values, first the pressure $p_v$ within the receptacle 30 is made equal to the pressure $p_L$ in the gas stream L* at a gas mass flow Lo*, which may be realized by pressure equalization via a vent 35. Then, at the output of the difference pressure sensor 33 there will result a difference pressure signal $p_L - p_v$ which, related to the pressure $p_{Lo}$ at the reference conditions, is equal to the relative change of density $\Delta\rho L/\rho Lo$ within the surrounding gas L, which relative change of density is at least nearly equal to the relative change of mass flow $\Delta L^*/Lo^*$ of the surrounding gas at at least nearly constant volume flow V* of the surrounding gas.

As was mentioned, one condition that is required for the output signal of the pressure difference measurement, with the help of sensor 33, to become proportional to the relative change of density $\rho_L$ or of gas mass flow L*, is that the gas of the stream L* and the gas within the receptacle 30 are held at the same temperatures. To ensure this condition, there will be provided a radiation screen 31 which prevents thermal radiation from impinging from outside into the surrounding gas, which would lead to measuring errors.

Figure 5:
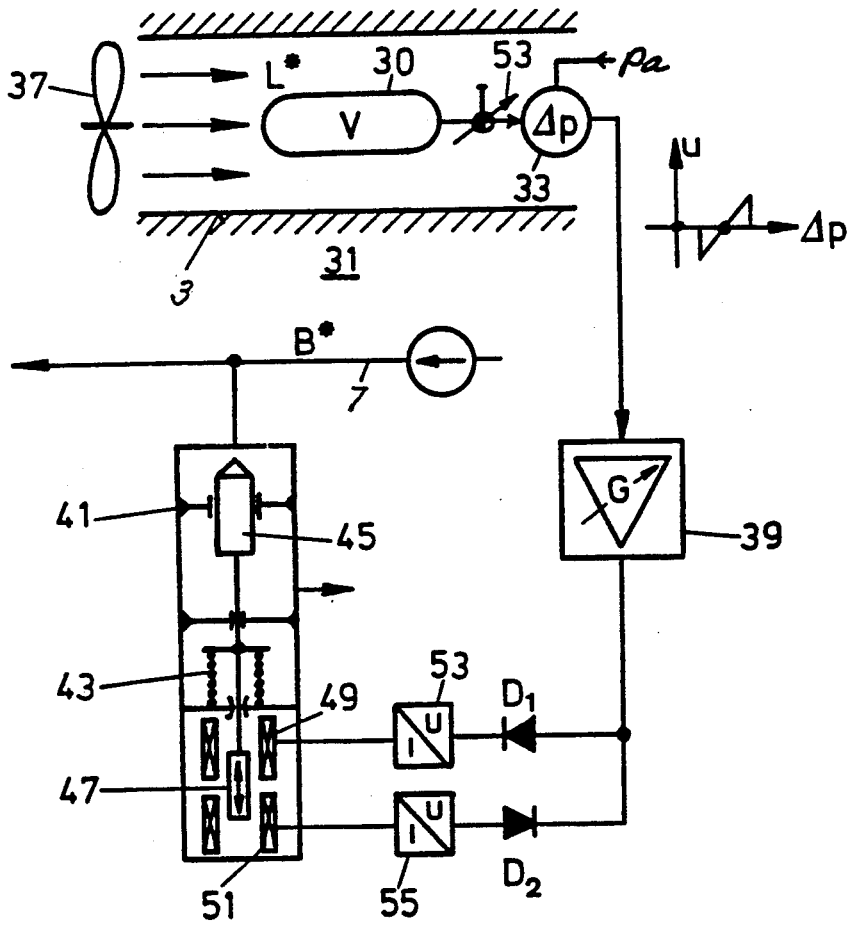

According to FIG. 5, there is arranged at the combustion air pipe 7 of a fan burner according to FIG. 2, a fan arrangement 37 and the closed receptacle 30, near or at the intake of the fan arrangement. The pressure difference sensor 33 measures the pressure difference between the static pressure $P_L$ within the flowing combustion air and the pressure $p_v$ of the gas filled in the receptacle 30 which gas is preferably air. The output signal of the sensor 33 is tailored to be symmetrical with respect to zero level. The output signal of the difference sensor 33 is applied to an amplifier 39, preferably with adjustable gain. The fuel pressure within the feed or conduit 3 to the burner is provided with a pressure regulated valve 41, shown schematically, and is controlled on a predetermined value. The valve body 45 which works in a feedback controlled sense against the force of a spring 43 comprises a magnetic drive arrangement 47 with an armature moved within two coils 49 and 51 which latter are fixed to the casing of the valve. At one polarity of the output signal of the amplifier 39, the coil 49 is fed via a diode D1 and a voltage to current converter 53. At the other polarity of said output signal of the amplifier 39, coil 51 is activated via an inversely polarized diode D2 and accordingly a voltage-to-current converter 55. Thereby the valve body 45 of the regulating valve 41 receives an additional disturbance value compensating displacement by the force which acts respectively from one of the coils 51, 49 according to the polarity of the output signal of amplifier 39. This adds a compensating force to the adjusting force according to the control deviation intrinsically provided in such a pressure control valve. Thereby the effects of the above mentioned predominant disturbances (temperature and pressure changes in the combustion air) on the combustion are compensated by adjusting the fuel flow B*. Details of a valve 41 which may be used are shown in the German patent 3 513 282.

To establish, according to formula (5), the initial conditions or reference conditions, e.g. when the burner is adjusted at its optimum, a pressure equilibrium is established between the inside of receptacle 30 and the surrounding air of air stream L* with the help of the vent 35 shown schematically.

Because the temperature within the combustion air stream changes only slowly, there will be practically no errors based on temperature equilibrium lag between air stream L* and air volume V. Further, a pressure change is practically instantaneously detected by difference pressure sensor 33, so that instantaneously the compensation too which is necessary may be applied to the flow of combustion air and/or to the flow of fuel to the burner.

I claim:

1. A method for measuring a relative change of density of a gas as a function of its pressure and of its temperature comprising the steps of:

providing a measuring gas within a closed receptacle of constant volume;

coupling said gas through a wall of said receptacle isothermically to said gas to be measured; and measuring a pressure difference change $P_L - P_V$ between the pressure of said gas to be measured $P_L$ and the pressure of said measuring gas within said receptacle $P_V$ as a measure of said relative change of density $\Delta\rho_L/\rho_{Lo}$, the relative change of density $\Delta\rho_L/\rho_{Lo}$ being related to the pressure difference $P_L - P_V$ in accordance with the following:

$$\frac{\Delta\rho_L}{\rho_{Lo}} = \frac{P_L - P_v}{P_{Lo}}$$

wherein:

$$\frac{P_L - P_v}{P_{Lo}} =$$

the pressure difference $P_L - P_V$ between the pressure $P_L$ of said gas being measured and the pressure $P_V$ of the gas within said receptacle with respect to a pressure $P_{Lo}$ at reference conditions, $$\frac{\Delta\rho_L}{\rho_{Lo}} =$$

change of density of said gas being measured with respect to its density at the reference conditions.

2. The method of claim 1, wherein said gas to be measured is flowing at a substantially constant volume flow and said measuring of said pressure difference is a measure of the relative change of mass flow of said gas to be measured.

3. An arrangement for measuring a relative change of density of a gas as a function of its pressure and of its temperature, comprising:

a closed rigid receptacle for a measuring gas, said receptacle for said measuring gas being isothermically coupled to said gas to be measured; and a pressure measuring arrangement, measuring a pressure difference between a pressure within said measuring gas receptacle and a pressure of said gas to be measured $\Delta P_L/P_{Lo}$, the relative change of density $\Delta\rho_L/\rho_{Lo}$ being related to the pressure difference $P_L - P_V$ in accordance with the following:

$$\frac{\Delta\rho_L}{\rho_{Lo}} = \frac{P_L - P_v}{P_{Lo}}$$

wherein:

$$\frac{P_L - P_v}{P_{Lo}} =$$

the pressure difference $P_L - P_V$ between the pressure $P_L$ of said gas being measured and the pressure $P_V$ of the gas within said receptacle with respect to a pressure $P_{Lo}$ at the reference conditions, $$\frac{\Delta\rho_L}{\rho_{Lo}} =$$

change of density of said gas being measured with respect to its density at the reference conditions.

4. The arrangement according to claim 3, said receptacle comprising vent means to establish pressure equilibrium between inside of said receptacle and said gas to be measured as an initial condition.

5. A method for reducing the effects of disturbances affecting the combustion of a fan burner system, wherein the fuel-to-combustion-air ratio of said system is adjusted in a feed-forward-control manner in dependency upon the temperature and the pressure of said combustion air, comprising the steps of:

providing a measuring gas within a closed receptacle of constant volume, arranged within said combustion air;

coupling said measuring gas through a wall of said receptacle isothermically to said combustion air;

measuring a pressure difference change $P_L - P_V$ between the pressure $P_L$ of said combustion air and the pressure $P_V$ of said measuring gas within said receptacle; and adjusting at least one of the mass flow of said combustion air and a fuel flow to said burner as a function of said pressure difference change.

6. The method according to claim 5, wherein a relative change of gas flow $\Delta L^*/L_o^*/d$ of said combustion air is determined by said measuring of said relative pressure difference between said pressure $P_V$ of said measuring gas within said receptacle and said pressure $P_L$ of said combustion air as follows:

$$\frac{\Delta_L^*}{L_o^*}/d \approx \frac{P_L - P_v}{P_{Lo}}$$

and wherein adjusting of said mass flow of said combustion air is performed at least according to:

$$\frac{\Delta_L^*}{L_o^*}/\text{comp} \approx \frac{\Delta_L^*}{L_o^*}$$

wherein:

$$\frac{\Delta L^*}{L_o^*} /d:$$

said relative change of said mass flow of said combustion air to the mass flow at reference conditions;

$$\frac{\Delta L^*}{L_o^*} /\text{comp}:$$

a compensating relative adjustment on the mass flow of said air flow, $$\frac{P_L - P_v}{P_{Lo}}:$$

the pressure difference $P_L - P_V$ between the pressure $P_L$ of said combustion air and the pressure $P_V$ of said measuring gas within said receptacle with respect to a pressure $P_{Lo}$ at reference conditions; and wherein said adjustment of said fuel flow is performed according to $$\frac{\Delta B^*}{B_o^*} /\text{comp} \approx \frac{\Delta L^*}{L_o^*} /d$$

wherein:

$$\frac{\Delta B^*}{B_o^*} /\text{comp}:$$

a compensating relative adjustment on the mass flow of said fuel flow with respect to a mass flow of said fuel flow at said reference conditions.

7. A fan burner arrangement comprising:

a burner;

a combustion air feed having a fan and a fuel feed;

at least one of a fuel flow adjusting means and a combustion air flow adjusting means within a respective one of said combustion air feed and said fuel feed;

a closed rigid receptacle with a measuring gas within said combustion air feed, said receptacle for said measuring gas being isothermically coupled to combustion air within said combustion air feed; and a pressure measuring arrangement measuring a pressure difference between a pressure within said closed rigid receptacle and a pressure of said combustion air, the output of said pressure measuring means being connected to at least one of said adjusting means for said combustion air flow and said adjusting means for said fuel flow.

8. The arrangement of claim 7, said control unit being arranged at an intake of a fan for said burner.

9. The arrangement according to claim 7, said receptacle comprising a vent means to establish an initial pressure equilibrium between said measuring gas and said combustion-air.

10. The arrangement according to claim 7, said fan burner being a fan burner to be operated at distinct values of loading as at one or two distinct loading levels.

* * * * *